United States Patent [19]

Takeuti

[11] Patent Number: 4,779,506

[45] Date of Patent: Oct. 25, 1988

[54] FINE TUNING MECHANISM IN ELECTRIC GUITAR

[76] Inventor: Toshitaka Takeuti, 28, Azanakasandanbata, Ooazasaitou, Fusou-cho, Niwagun, Aichi-ken, Japan

[21] Appl. No.: 1,431

[22] Filed: Jan. 8, 1987

[30] Foreign Application Priority Data

Aug. 13, 1986 [JP] Japan ..... 61-124143

[51] Int. Cl.[4] ..... G10D 3/04

[52] U.S. Cl. ..... 84/313; 84/267; 84/298

[58] Field of Search ..... 84/267, 298, 299, 312 R, 84/313

[56] References Cited

U.S. PATENT DOCUMENTS 4,475,432 10/1984 Stroh ..... 84/314 N
4,506,585 3/1985 Desmond ..... 84/298
4,549,460 10/1985 Gressett et al. ..... 84/298
4,608,905 9/1986 Takabayashi ..... 84/313
4,632,005 12/1986 Steinberger ..... 84/313
4,672,877 6/1987 Hoshino et al. ..... 84/299

*Primary Examiner*—Lawrence R. Franklin
*Attorney, Agent, or Firm*—Wenderoth, Lind & Ponack

[57] ABSTRACT

A fine tuning mechanism in a tremolo unit of an electric guitar which includes a body section having a horizontal portion and a vertical portion rising from a rear end side of the horizontal portion and formed in an L-like shape, and a block section extending downward from the horizontal portion of the body section. The horizontal portion has a bridge saddle held thereon, a slider is held on the bridge saddle and is slidable in a longitudinal direction and a fine tuning screw is provided for sliding the slider in the longitudinal direction. The fine tuning mechanism allows a muted performance to be accomplished smoothly and the fine tuning can be performed smoothly at a light touch while obtaining a large adjustment width.

9 Claims, 3 Drawing Sheets

FINE TUNING MECHANISM IN ELECTRIC GUITAR

BACKGROUND OF THE INVENTION

1. Field of the Invention

The present invention relates to a fine tuning mechanism in a tremolo unit of an electric guitar, and more specifically to a fine tuning mechanism which is installed to perform fine adjustment of the tension of a string.

2. Description of the Prior Art

In electric guitars in general, a tremolo unit is installed at a body side and one end of a string is hooked to the tremolo unit, and on the other hand a peg is installed at a neck side and the other end of the string is wound on the peg and when the peg is rotated the tension of the string can be adjusted. However, since fine adjustment cannot be obtained by the peg, a fine tuning mechanism is installed at the side of the tremolo unit.

FIGS. 4 and 5 show a concrete structure of such constitution. Symbol a designates a tremolo unit, symbol b designates a body section of the tremolo unit a, and symbol c designates a block section extending downward from the body section b. Symbol d designates a string locking rod which is pivotally attached to a horizontal portion of the body section b and rotatable up and down, and a string locking hole e is opened at a position to the rear end side of the string locking rod d in the vertical direction. A string pushing piece f having a flange at a bottom portion thereof and formed in a nearly rectangular plate shape is installed in the string locking hole e, and the flange of the string pushing piece f is engaged with the bottom surface of the string locking rod d such that the string pushing piece f is slidable in the longitudinal direction. A string locking screw g is installed at a rearward position of the string locking rod d and is movable in the longitudinal direction. The string locking screw g is threadedly engaged with the string locking rod d and is aligned with the string pushing piece f so that one end of a string h can be grasped between the string locking rod d and the string pushing piece f. A rising section i is installed at a rear end side of the horizontal portion of the body section b, and a fine tuning screw j corresponding to the string locking screw g is installed on the rising section i and is movable up and down. When the fine tuning screw j is threadedly engaged in a downward direction, the string locking rod d can be rotated downwardly. That is, the string locking rod d is rotated downwardly, so that fine adjustment of the tension of the string h can be finally performed.

In a tremolo unit having the structure of the prior art, a fine tuning mechanism is projected upward. That is, since a rising section is installed at a rear end side of the body section as above described and a fine tuning screw is threadedly engaged with the rising section and is movable up and down, for example, when a muted a (performance method of performing where a hand is put on a bridge saddle so as to suppress the sound) is done, the hand may be caught by the fine tuning mechanism resulting in a malfunction in that the muted performance is obstructed.

SUMMARY OF THE INVENTION

An object of the invention is to provide a fine tuning mechanism in an electric guitar wherein a hand of a player cannot be caught by the fine tuning mechanism during the muted performance.

Another object of the invention is to provide a fine tuning mechanism in an electric guitar wherein fine tuning with a large adjustment width can be performed smoothly with a light touch.

In order to attain the above objects, the invention takes the following concrete means.

In a tremolo unit comprising a body section having a horizontal portion and a vertical portion rising from rear end side of the horizontal portion and formed in L-like shape, and a block section extending downward from the body section, and a block section extending downward from the body section, the body section having a bridge saddle held on the horizontal portion, a slider is held on the bridge saddle and slidable in the longitudinal direction and means for sliding the slider in the longitudinal direction is provided.

DESCRIPTION OF THE PREFERRED EMBODIMENTS

Figure 2:
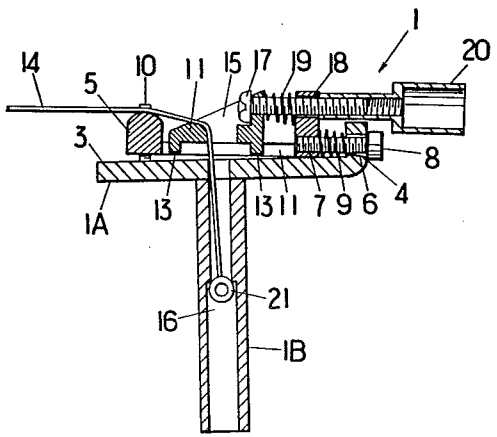
FIG. 2 is a side sectional view illustrating a tremolo unit as a whole having a fine tuning mechanism of the invention.
Figure 1:
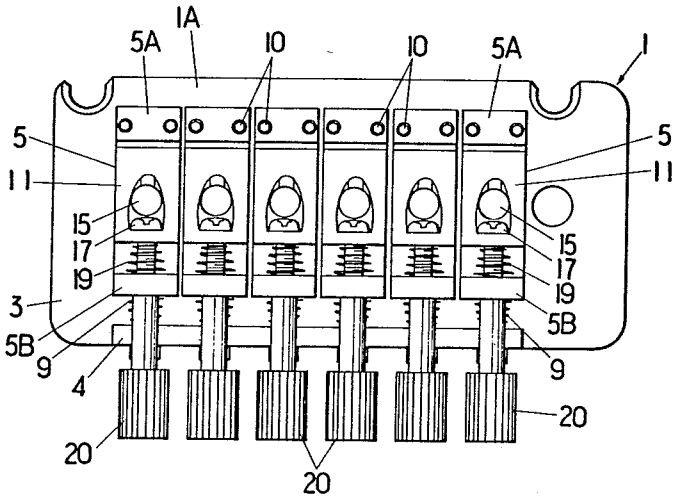
FIG. 1 is a plan view illustrating a tremolo unit as a whole having a fine tuning mechanism of the invention.
Figure 3:
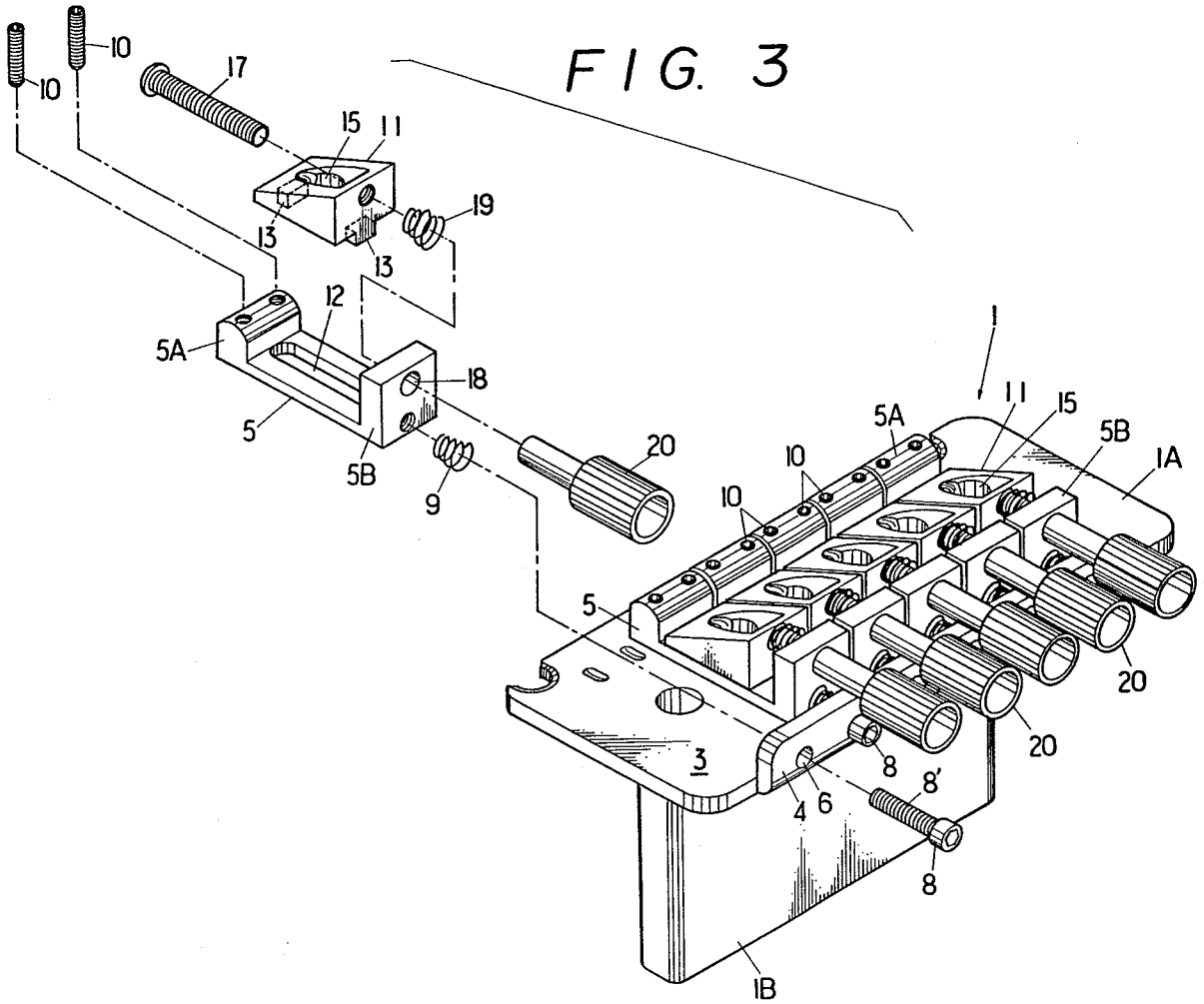
FIG. 3 is an exploded perspective view illustrating a tremolo unit as a whole having a fine tuning mechanism of the invention.
Figure 5:
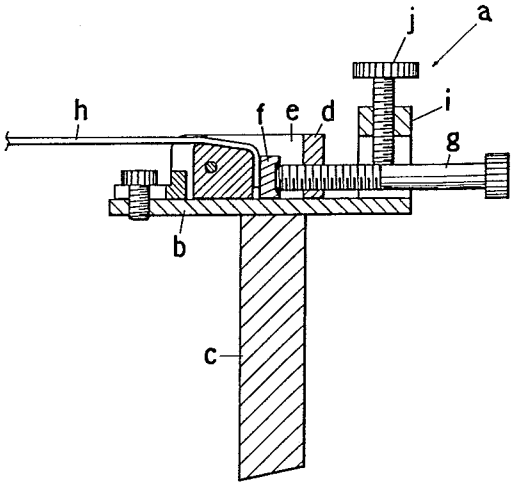
FIG. 5 PRIOR ART
FIG. 5 is a side sectional view illustrating a tremolo unit as a whole having a fine tuning mechanism of the prior art.
Figure 4:
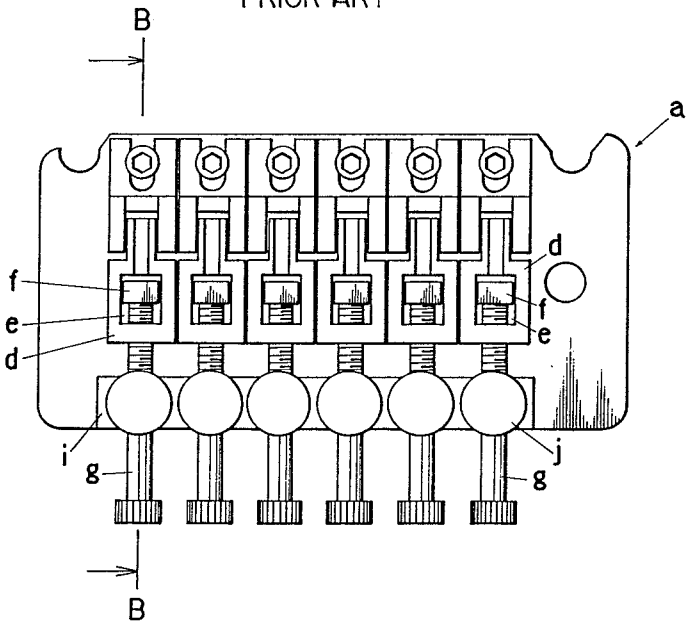
FIG. 4 PRIOR ART
FIG. 4 is a plan view illustrating a tremolo unit as a whole having a fine tuning mechanism of the prior art.

In FIGS. 1 through 3, reference numeral 1 designates a tremolo unit of a knife edge type. The tremolo unit 1 comprises a body section 1A, and a block section 1B which extends perpendicularly downward to the body section 1A. The body section 1A is composed of a horizontal portion 3 and a vertical portion 4 rising from a rear end side of the horizontal portion 3, and therefore is formed in an L-like shape extending in a longitudinal direction. A plurality of bridge saddles 5 with the number thereof corresponding to the number of strings are installed on the body section 1A so that they are freely adjustable in traveling adjustment (octave adjustment). That is, each bridge saddle 5 is held on the horizontal portion 3 and extends in the longitudinal direction, and a through hole 6 opposed to each bridge saddle 5 is bored on the vertical portion 4. A tapped hole 7 for the octave adjustment is bored on a rear wall portion 5B of each bridge saddle 5 as hereinafter described, and on the other hand, an octave adjusting screw 8 is loosely fitted in each through hole 6 and a free end threaded portion 8' of the screw 8 is threadedly engaged with the tapped hole 7 and whereby the respective bridge saddle can be moved freely. A helical spring 9 surrounds each adjusting screw 8 and is interposed between the bridge saddle 5 and the vertical portion 4 of the body section 1A, whereby each adjusting screw 8 and each bridge saddle 5 are normally biased in a forward direction. Each bridge saddle 5 is provided at a front end portion thereof with a saddle portion 5A and at a rear end portion with the rear wall portion 5B, respectively, projecting integrally upwardly therefrom. String height adjusting screws 10, 10 have ends which penetrate vertically through both lateral end portions of the saddle portion 5A and the screws 10, 10 are threadedly engaged with the saddle portion 5A so as to be movable up and down. A slider 11 for fine tuning is interposed between the saddle portion 5A and the rear wall portion 5B, and is movably held on the bridge saddle 5 for movement in the longitudinal direction. That is, a guide hole 12 through the bridge saddle 5 extends in the longitudinal direction and a longitudinal pair of guide pieces 13, 13 are projected downwardly from the lower side of the slider 11, so that both guide pieces 13, 13 are movably engaged within the guide hole 12. Each slider 11 has an upper slant surface which is inclined downwardly toward the saddle portion 5A and the slider is formed in a right triangle shape when viewed from the lateral side. A through hole 15 for a string 14 extends in a vertical direction through the slider 11, and the through hole 15 communicates through the guide hole 12 with a locking hole 16 which is bored in the block section 1B for engaging a ball end portion 21 of a string 14. An adjustment screw rod 17 is projected rearwardly from a rear wall portion of the slider 11, and a free end portion of the adjustment screw rod 17 penetrates a through hole 18 extending through the rear wall portion 5B of the bridge saddle 5. A helical spring 19 surrounds each adjustment screw rod 17 and is interposed between the slider 11 and the rear wall portion 5B of the bridge saddle 5, so that each adjustment screw rod 17 and each slider 11 are normally biased forwardly. A fine tuning screw 20 has an internally threaded bore which is threadedly engaged with a threaded outer periphery of the adjustment screw 17 and is movable horizontally in the longitudinal direction, and a free end portion of the fine tuning screw 20 abuts against the rear wall portion 5B of the bridge saddle 5.

Operation of the fine tuning mechanism will now be described.

When the string 14 is inserted in the through hole 15 extending through the slider 11 and a ball end portion 21 connected to one end of the string 14 is engaged with an upper end of the locking hole 16 bored in the block section 1B, the other end of the string 14 is wound on a peg installed at the neck side, whereby the string 14 can be stretched to a desired tension. When the string 14 is stretched as above described and the string height adjusting screw 10 is rotated, the saddle portion 5A projecting at the front end portion of the bridge saddle 5 can be floated to a suitable height, whereby the string height can be adjusted to a suitable height. When the adjusting screw 8 is rotated, the bridge saddle 5 can be moved, whereby the octave adjustment can be performed. When the string height adjustment and the octave adjustment are obtained as above described and the fine tuning screw 20 is rotated, the slider 11 can be moved in the longitudinal direction, whereby fine adjustment of the tension of the string 14 can be performed. The free end portion of the fine tuning screw 20 abuts on the rear wall portion 5B of the bridge saddle 5 and the fine tuning screw 20 is rotated in a horizontal state, whereby the fine tuning screw 20 can be rotated smoothly without interposing a bearing or the like and can be held without producing looseness in the adjusted tension of the string 14. Since the adjustment screw rod 17 (male screw) is engaged with the fine tuning screw 20 (female screw) and the fine tuning screw 20 is rotated to cause movement of the adjustment screw rod 17 so that the fine tuning is performed, the fine tuning can be obtained with a large width. Moreover, since an intermediate portion of the string 14 is engaged with the slider 11 which is horizontally moved in the longitudinal direction so that the fine tuning is performed, the string 14 can be pulled with a light touch in comparison to the case where the end portion of the string 14 is pulled in the some direction.

Since the top of the saddle portion 5A of the bridge saddle 5 has a slanted surface descending rearwardly, when the tremolo unit 1 is operated in the up action (i.e., when the tremolo unit 1 is rotated so that the tension of the string 14 is temporarily loosened) the string 14 is prevented from floating above the top of the saddle portion 5A whereby rapid lowering of the musical interval is prevented.

Furthermore, since the top of the saddle portion 5A of the bridge saddle 5 is slanted rearwardly, the string 14 is closely contacted with the surface of the saddle portion 5A whereby the adjusted tension does not vary and the chatter phenomenon can be eliminated.

While the present invention has been described with reference to the foregoing embodiments, it will be understood that many changes and variations may be made thereto which fall within the scope of the appended claims.

What is claimed is:

1. A fine tuning mechanism for a tremolo unit of an electric guitar, comprising:

a body section having a horizontal portion and a vertical portion extending upwardly from a rear end of the horizontal portion;

a block section extending downwardly from the horizontal portion of the body section, said block section including a locking hole means therein for engaging a ball end portion of a string;

a bridge saddle movably mounted on the horizontal portion for movement in a longitudinal direction, the bridge saddle including a saddle portion having means thereon for engaging a respective string of the guitar;

a slider movably mounted on the bridge saddle for movement in the longitudinal direction, the slider having means thereon for engaging the string of the guitar at a position between the saddle portion of the bridge saddle and the vertical portion of the body section;

the horizontal portion of the body section having a through hole therein in communication with the locking hole means for passage of the string over the slider and saddle portion of the bridge saddle;

means connected between the bridge saddle and the vertical portion of the body section for moving the bridge saddle in the longitudinal direction with respect to the body section; and means connected between the slider and the bridge saddle for biasing the slider away from the bridge saddle and for moving the slider in the longitudinal direction with respect to the body section.

2. The fine tuning mechanism of claim 1, wherein the means for moving the bridge saddle comprises an octave adjusting screw extending through an aperture in the vertical portion of the body section, the octave adjusting screw having a head at one end thereof engaging a rear surface of the vertical portion of the body section and a threaded portion at the other end thereof in threaded engagement with a tapped hole in the bridge saddle, the means for moving the bridge saddle further comprising a spring surrounding the octave adjusting screw and interposed between the bridge saddle and the vertical portion of the body section.

3. The fine tuning mechanism of claim 1, wherein the means for biasing the slider away from the bridge saddle and for moving the slider comprises an adjustment screw rod, a fine tuning screw and a spring, the adjustment screw rod extending in the longitudinal direction from the slider and through an aperture in a rear wall portion of the bridge saddle, the fine tuning screw being threadedly engaged with the adjustment screw rod with a portion of the fine tuning screw in contact with the rear wall portion of the bridge saddle, the spring surrounding the adjustment screw rod and interposed between the slider and the rear wall portion of the bridge saddle.

4. The fine tuning mechanism of claim 1, wherein the saddle portion of the bridge saddle includes string height adjusting screws in contact with the horizontal portion of the body section for adjusting a height of the string engaging means of the saddle portion above the horizontal portion of the body section.

5. The fine tuning mechanism of claim 1, wherein the bridge saddle includes a slot extending in the longitudinal direction and the slider includes means thereon for engaging the slot during movement of the slider in the longitudinal direction.

6. The fine tuning mechanism of claim 1, wherein the string engaging means of the slider comprises an upper surface thereon, the upper surface including a first portion which is inclined downwardly towards the horizontal portion of the body section and a second portion which is substantially horizontal, the second portion being between the first portion and the saddle portion of the bridge saddle.

7. A fine tuning mechanism in a tremolo unit of a knife edge type of an electric guitar, comprising an L-shaped body section having a horizontal portion and a vertical portion extending upwardly from a rear end side of the horizontal portion, and a block section extending downwardly from the horizontal portion of the body section, said horizontal portion having a bridge saddle movably mounted thereon for movement in a longitudinal direction towards and away from the vertical portion, an octave adjusting screw having one end engaged with the vertical portion of the body section and another end threadedly engaged with a rear wall portion of said bridge saddle, said bridge saddle being movable in the longitudinal direction by rotating said octave adjusting screw, a slider movably mounted on the bridge saddle for movement in the longitudinal direction, the slider being provided with a through hole for passing a string therethrough to a string locking hole bored in the block section, an adjustment screw rod extending rearwardly from a surface of the slider facing the vertical portion, the adjustment screw rod having a free end portion extending through a rear wall portion of the bridge saddle, and a rotatable fine tuning screw threadedly engaged with the free end portion of the adjustment screw rod and a free end portion of the fine tuning screw abutting against the rear wall of the bridge saddle.

8. A fine tuning mechanism as set forth in claim 7, wherein the slider is mounted at a rear side of a saddle portion of the bridge saddle, the bridge saddle having an upper surface which extends further from the horizontal portion of the body section than an upper surface of a string engaging surface of the slider extends from the horizontal portion of the body section.

9. A fine tuning mechanism as set forth in claim 7, wherein the adjustment screw rod is a male screw and the fine tuning screw is a female screw, and a helical spring surrounds the adjustment screw rod and is interposed between the slider and the rear wall portion of the bridge saddle.

* * * * *